United States Patent [19]

Leloux

[11] 4,104,942

[45] Aug. 8, 1978

[54] DEVICE FOR MANUFACTURING PERFORATED PLASTIC PIPES

[75] Inventor: Arnoldus Willem Jan Leloux, Dedemsvaart, Netherlands

[73] Assignee: Wavin B.V., Zwolle, Netherlands

[21] Appl. No.: 742,237

[22] Filed: Nov. 16, 1976

[51] Int. Cl.[2] ..... B26F 1/06

[52] U.S. Cl. ..... 83/327; 83/54; 83/622; 83/660

[58] Field of Search ..... 83/54, 327, 328, 660, 83/622

[56] References Cited

U.S. PATENT DOCUMENTS

| | | | |
|---|---|---|---|
| 1,620,546 | 3/1927 | Grover | 83/327 X |
| 2,262,919 | 11/1941 | Bruker | 83/328 X |
| 3,266,352 | 8/1966 | Kuts | 83/622 X |
| 3,560,312 | 2/1971 | Smith | 83/327 X |
| 3,620,115 | 11/1971 | Zieg et al. | 83/660 X |
| 3,901,113 | 8/1975 | Oltmanns et al. | 83/660 X |

*Primary Examiner*—J. M. Meister

*Attorney, Agent, or Firm*—Wilkinson, Mawhinney & Theibault

[57] ABSTRACT

A method for manufacturing perforated plastic pipes, in particular corrugated thermoplastic pipes of which the wave valleys are perforated by at least one punching member, to which a velocity is imparted in the direction of conveyance of the plastic pipes, which equals the rate of conveyance of these pipes. During the punching operation the punching member or members retain substantially a perpendicular position with respect to the plastic pipes.

7 Claims, 2 Drawing Figures

DEVICE FOR MANUFACTURING PERFORATED PLASTIC PIPES

Figure 1:
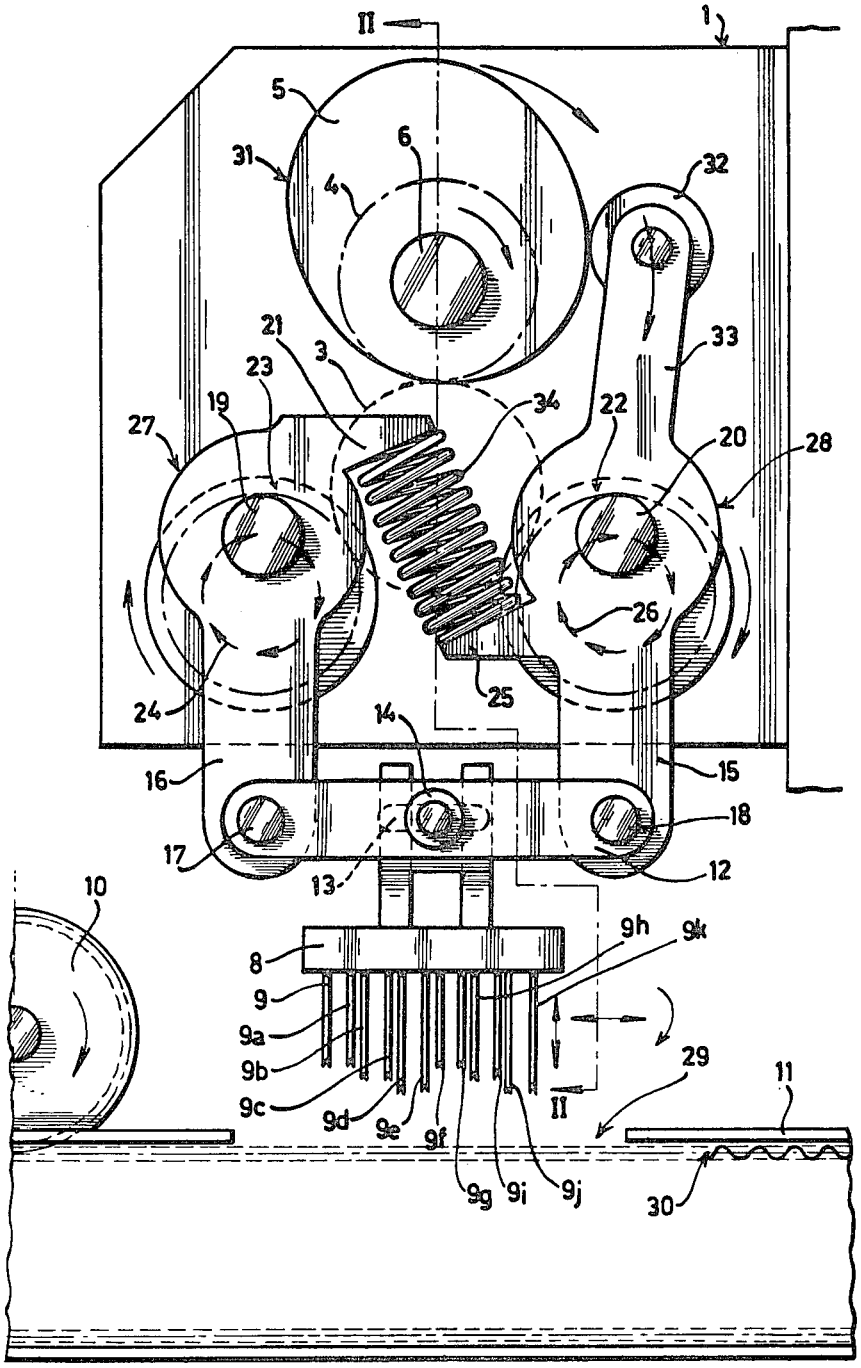

The invention relates to a method for manufacturing perforated pipes particularly corrugated thermoplastic pipes with perforated wave valleys by conveying plastic pipes continuously through a perforation zone and perforating them due to the action of at least one movable punching member.

Such a method is known. According to the known method plastic pipes are passed through a hollow guide, punching members being pressed, by means of a cam disc, into or through the wall of the plastic pipes at particular moments, forming the desired openings.

As long as the perforating operation is carried out at a rather low rate of pipe transportion the suitable elastic properties of the material used for the punches can be selected such, that during their cooperation with plastic pipes they are capable of deflecting thus that they can be removed from the plastic pipes later on without any fractures. A disadvantage is, however, that the punches which only perform a radial movement hit pipes which are conveyed in a direction perpendicular thereto.

Faster conveyance rates of plastic pipes are in great demand, as extruders manufacturing plastic pipes can at present operate at considerably faster rates. Hence the problem occurs that on the one hand punches acting upon plastic pipes are caused to bulge too much, which gives rise to undesired fractures of the punches and to disturbances in the production process, while on the other hand the punches can be easily damaged by the forces produced when plastic pipes and punch contact each other.

The invention aims to provide a method which does not present the aforementioned disadvantages.

This object is attained according to the invention by the arrangement that at least during the cooperation time with the plastic pipes, a velocity in the direction of conveyance is imparted to a punching member which equals the rate of conveyance of the plastic pipes and that during their action the punches retain substantially a perpendicular position with respect to the plastic pipes.

It is thus possible to operate at much faster rates since the velocity of movement of the punches enables an operating structure which can stand considerable bulging without fracture.

When the punches are moving in the direction of conveyance of the plastic pipes they can moreover, be conveyed very fast without adapting their properties to these much faster rates of conveyance, which mostly may surpass twice or thrice the rate, which is permissible in the known devices.

The punching member is conveniently moved towards and from the pipes by means of a punch holder connected with two eccentrics, the movement of the punching member being related to the rate of conveyance of the pipes.

During the entire cooperation of the punch with the plastic pipes the punch should be likewise conveyed in the direction of conveyance at a rate which is identical to the rate of conveyance of the plastic pipes. In this manner each deformation of the punches during the cooperation of punches with plastic pipes is completely avoided.

Finally it is advisable to convey a punch at a rate in the direction of conveyance of the plastic pipes which equals the rate of conveyance of the plastic pipes in the area in which the punch is retracted from its position of cooperation with the plastic pipes. In this way a deformation of the punch, if any, is avoided during its removal from the plastic pipes.

The invention in an other aspect relates to a device for continuously perforating plastic pipes, particularly corrugated plastic pipes, comprising a guide member for the plastic pipes, a pipe conveying member for the transportion of the plastic pipes, a punching member for punching holes in the plastic pipes and an operating member for causing the punching member to perforate the plastic pipes.

Such a device is likewise known and presents the aforementioned disadvantages.

In order to obviate these difficulties and in particular to provide a device which lends itself well for perforating plastic pipes when much faster rates of conveyance are used such a device is provided with punching member actuators for causing the punching members to move with the same velocity as the pipe conveying members, at least when the punching members act upon the pipes to be perforated, and in order to preserve a substantially perpendicular position with respect to the conveyed pipes when the punching members are in action.

Thus the rate of conveyance of plastic pipes can be considerably stepped up without the risk of fracture of the punching members and without the necessity of adapting the bending properties thereof.

In a particularly convenient fashion the punching member actuators for causing the punching members to move with the same velocity as the pipe conveying members, at least when the punching members act upon the pipe to be perforated, consists of a first eccentric member.

The device is efficiently provided with a punching member disposed on a punching member holder being connected with two eccentrics which can be actuated by one driving mechanism, while the first eccentric member acts upon the two eccentrics.

Very good results are obtained by means of this device since it operates very uniformly during the perforation operation, even when the pipes to be perforated are passed at very fast rates.

The invention is hereinafter clarified with reference to the drawing in which a device for performing the method according to the invention is represented.

Figure 2:
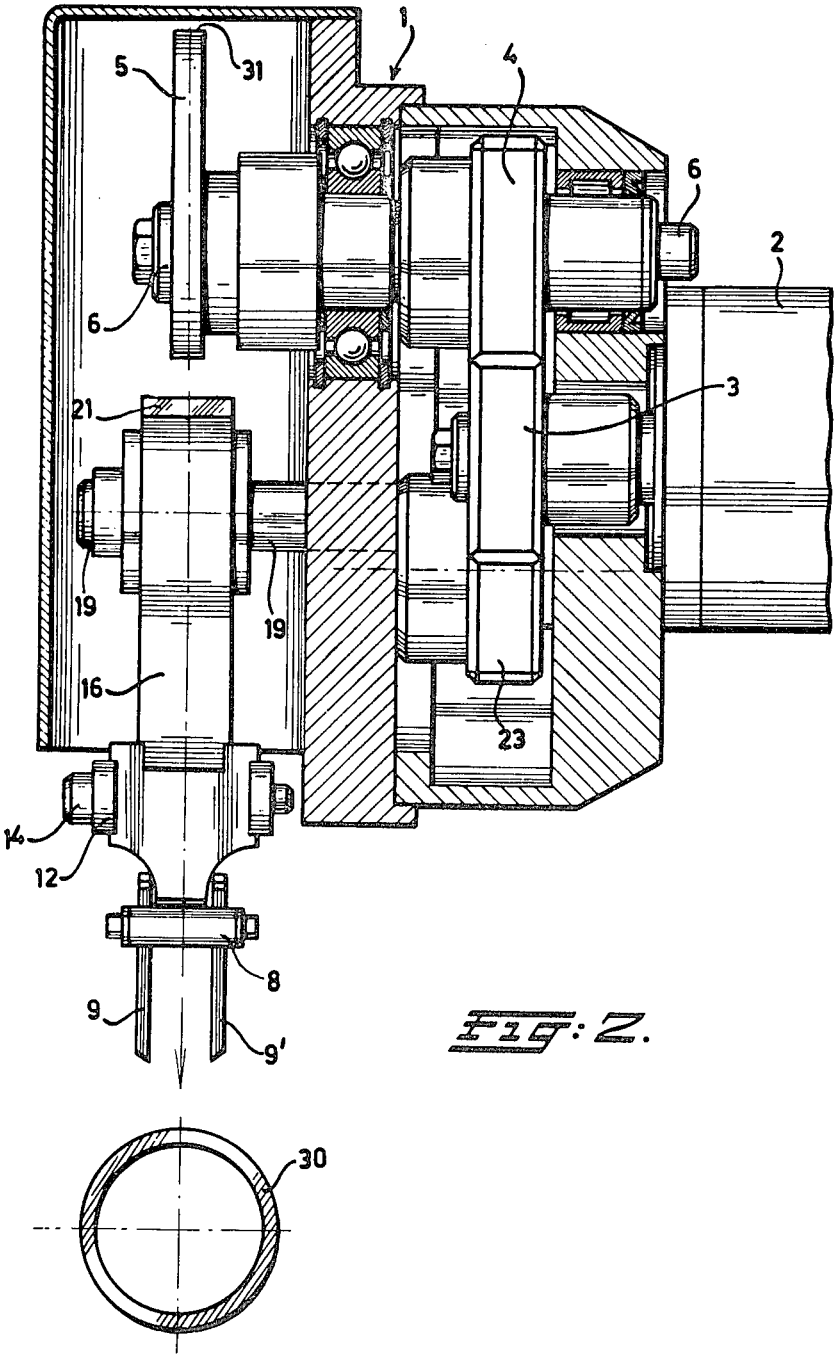

In the drawing:

FIG. 1 shows a front view of a device for continuously perforating plastic pipes and FIG. 2 is a side elevation of such a device.

The drawing shows a device for continuously perforating the wave valleys of plastic pipes, particularly corrugated thermoplastic pipes such as polyvinylchloride. The device has a box 1 with a driving motor 2 driving a driving gear 3 through a shaft 25. This driving gear 3 drives gear wheels 22 and 23 which are connected with the eccentric discs 27 and 28. During the rotation of the driving gear wheel 3 and the gear wheels 22 and 23, the gear wheels rotating all at the same speed of rotation, the eccentric shafts 19 and 20 of the eccentric discs 27 and 28 move according to the arrows 26 and 24, whereby a downward movement is imparted to the driving rods 15 and 16.

The driving rods 15 and 16 are pivotally connected through pivots 17 and 18 with the connecting beam 12 in which is provided an elongate slit 13. In this elongate slit 13 is secured, through a screw 14, a supporting beam 8, carrying pairs of punches 9, *9a*, *9b*, *9c*, *9d*, *9e*, *9f*, *9g*, *9h*, *9i*, *9j* and *9k*, so that, when the driving rods move downwards also the punches 9, *9a* etc. are moved down.

A conveying wheel 10 is mounted for conveying corrugated plastic pipes 30, which pipes may be surrounded by an envelope 11 with an opening 29 through which the punches can act. The envelope 11 may be gutter-shaped or consist of strips where in between are open spaces.

When the eccentrics would be caused to act in this way upon the punches, then one would be forced to use complicated mechanisms in order to adapt the rate of conveyance of the plastic pipes to the velocity of the punches 9 which velocity is defined by the eccentric shafts 15 and 16. It is, however, almost impossible in practice to modify discontinuously the pipe velocity.

So as to overcome this trouble a first eccentric mechanism, being a cam 5 with an eccentric circumference 31, is mounted, which cam 5 is mounted on a shaft 6, the latter being connected with a cam driving gear wheel 4 which cooperates with a driving gear wheel 3.

A cam roller 32, secured to an eccentric disc 28 through a rod 33 continuously cooperates with the circumference 31 of the cam 5, due to the action of a spring 34 cooperating with a saddle member 25 on an eccentric disc 28 and with a saddle member 21' on an eccentric disc 27.

The cam 5 rotates with the same velocity as the eccentric discs 27 and 28 owing to an active driving gear wheel 3. When the circumference of the cam disc 5 and the speed of rotation thereof are suitably selected the punches 9 etc. can be moved with the same velocity as the plastic pipes 30 during their action thereupon.

During rotation of the cam 5 and due to the eccentric circumference thereof, the eccentric driving rod 15 will not only be subjected to a movement of the eccentric shaft 20 but also be influenced by the cam 5, while due to a spring 34 driving rod 16 undergoes the same movement as driving rod 15. This means that the supporting beam 8 together with punches on account of its fixed connection with the connecting rod 12 does not only undergo a downwardly directed movement in order to cause the corrugated pipes 30 to cooperate with the punches 9, but also a backward-forward movement respectively, to keep the linear velocity of the supporting beam 8 uniform in spite of the normal non-uniform velocity of the supporting beam 8, on account of the eccentrics.

Should it be desired to impart an additional left-hand movement to the punches 9 in a device according to the invention, this can be effected by increasing the diameter of the cam 5 at the location of the cam roller 32; when the diameter of the cam is decreased, an additional right-hand movement is achieved.

The motor 2 normally drives both a driving gear wheel 3 and a conveyor wheel 10 for moving punches 9 and pipes 30 at an identical rate.

In the drawing 12 pairs of opposite punches 9, 9' etc. disposed on a supporting beam 8, are shown.

Although these punches 9, *9a*, *9b* could all simultaneously contact plastic pipes 30, it is advisable to perform this stepwise. For that purpose the lengths of the punches differ, so that first the longest pairs of punches *9d*, *9e*, *9j* and *9k* contact the plastic pipes and subsequently pairs of punches *9b*, *9c*, *9h* and *9i*, whereafter the remaining pairs of punches follow.

The pairs of punches 9, 9' etc. are disposed in planes which may assume a position perpendicular to the axis of envelope 11, their spacing being selected such that the punches contact the pipes 30.

When the pipes have a substantially helical profile then the pairs of punches are arranged in such a way that they can operate in two consecutive wave valleys.

What I claim is:

1. A device for continuously perforating plastic pipes, particularly corrugated thermoplastic pipes, comprising a tubular guide member for the plastic pipes, a pipe conveying member (10) for conveying the pipes, a punching member comprising a first eccentric member (5), eccentrics (15,16) cooperating with said first eccentric member (5) for causing the rate of advance of the punching members to proceed uniformly at the stage of punching for punching holes in the plastic pipes moving in an orbit free from said hollow tubular tube support, an actuating member (2) causing the punching member to act upon the pipes to be perforated, said two eccentrics (15,16) being interconnected via a connecting rod (12) carrying one or more punching members (9), said first eccentric member (5) being driven at the same rate, said device having punching member actuating means for causing the punching members to move at the same rate as the pipe conveying members (10), at least when the punching members act upon the pipes to be perforated, and to preserve a substantially perpendicular position with respect to the conveyed pipes when the punching members are in action, eccentrics (15,16) carrying saddle members (21,25), and a spring (34) being provided between the two saddle members (21,25).

2. A device as claimed in claim 1, wherein one of the eccentric discs (15,16) is connected, via a rod (12), with a cam roller (32) which cooperates with the eccentric cam (5).

3. A device as claimed in claim 2, having a driving member which is coupled to a driving gear wheel (3) cooperating with gear wheels which carry the two eccentric discs (27,28) of eccentrics (15,16) and with a gear wheel on the cam (5).

4. A device as claimed in claim 3, wherein the driving means (2) cooperate with the pipe conveying member.

5. A device as claimed in claim 4, wherein the connecting beam carries a beam, carrying more parallel arranged pairs of punching members *(w,9a,9b)*.

6. A device as claimed in claim 5, wherein the punching members *(9,9a,9b)* have different lengths.

7. A device as claimed in claim 6, wherein the longest punching members *(9,9a,* etc.) are located at the end of the beam (12) which constitutes the rear end of the beam as seen in the direction of movement of the beam.

* * * * *